United States Patent [19]

McKee

[11] Patent Number: 4,715,472

[45] Date of Patent: Dec. 29, 1987

[54] ADJUSTABLE MOTORCYCLE MUFFLER

[76] Inventor: J. Ward McKee, 7021 E. Alondra Blvd. #7, Paramount, Calif. 90723

[21] Appl. No.: 902,748

[22] Filed: Sep. 2, 1986

[51] Int. Cl.[4] ..... F01N 1/18

[52] U.S. Cl. ..... 181/241; 181/239; 181/264

[58] Field of Search ..... 181/240, 241, 243, 251, 181/268, 271, 277, 239, 264

[56] References Cited

U.S. PATENT DOCUMENTS 3,145,800 8/1964 Marx ..... 181/241

3,545,566 12/1970 Frolunda ..... 181/241

*Primary Examiner*—Benjamin R. Fuller

*Attorney, Agent, or Firm*—Edgar W. Averill, Jr.

[57] ABSTRACT

An adjustable motorcycle muffler affixable to the exhaust pipe of a motorcycle. The muffler includes a stationary ring which is affixed to the exit end of the muffler body and the stationary ring has several openings therethrough. An adjustable ring is affixed to the face of the stationary ring and is movable to increase or decrease the gas flow resistance through the stationary ring.

17 Claims, 12 Drawing Figures

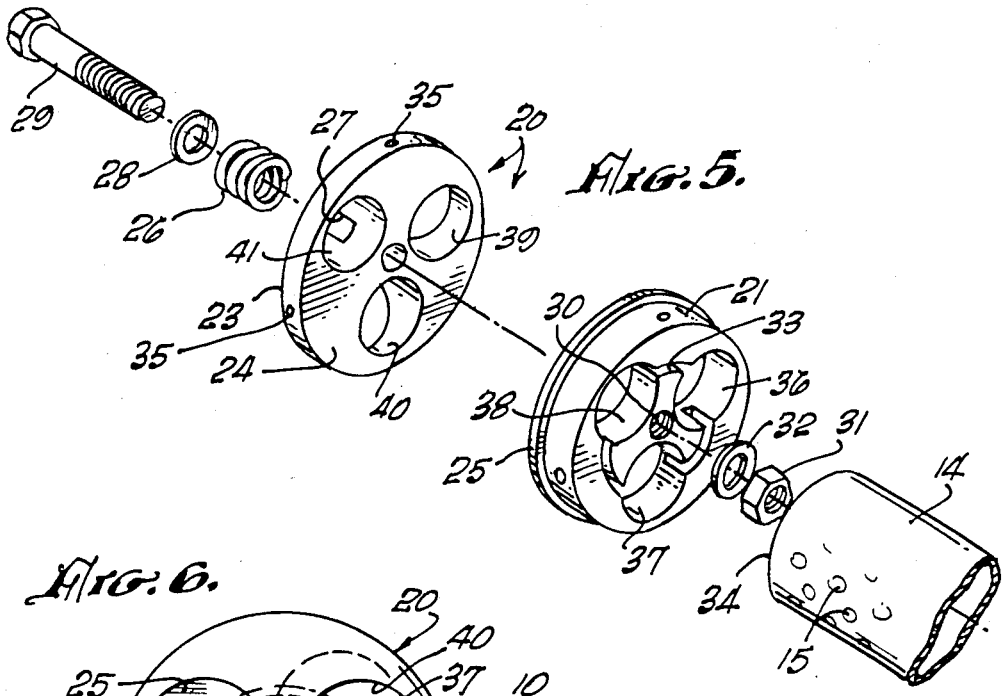
FIG. 5.
FIG. 6.
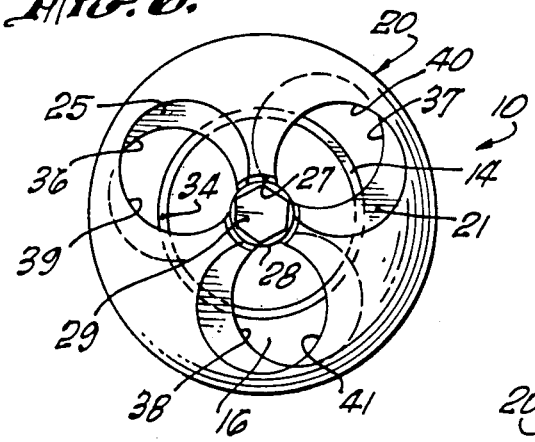
FIG. 7.
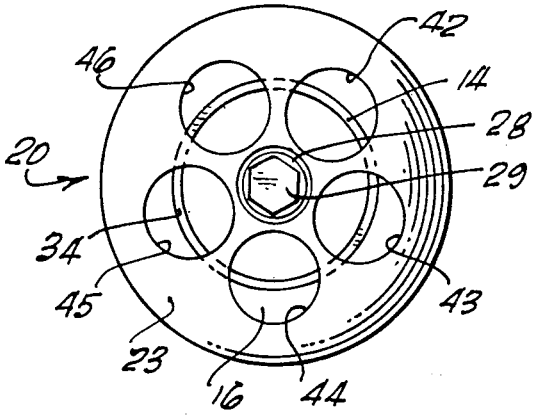
FIG. 8.
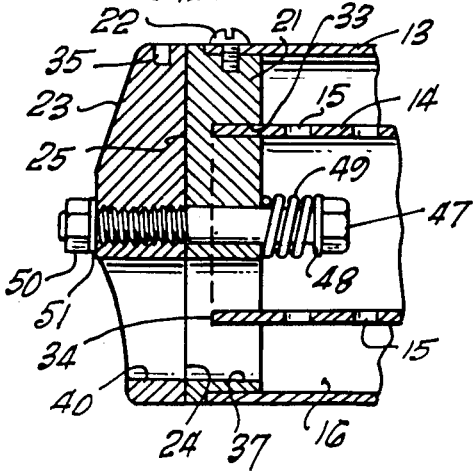

ADJUSTABLE MOTORCYCLE MUFFLER

BACKGROUND OF THE INVENTION

The field of the invention is mufflers for internal combustion engines and the invention relates more specifically to mufflers for engines of the type commonly used on motorcycles. It is desirable to have an optimum amount of back pressure to optimize the efficiency of the the engine. The amount of back pressure also affects the noise, and the typical motorcycle muffler is designed to provide a compromise of backflow for a perceived average user. However, because motorcycle engines are often upgraded or altered with improved performance carburetors and other accessories, the preconceived amount of back pressure is often not equal to the optimum back pressure in any given situation.

It is, thus, beneficial to provide a muffler which has an adjustable amount of back pressure. One such design of muffler utilizes a plurality of disks inserted near the exit face thereof and the greater number of disks inserted, the lower the back pressure. Such system, however, is relatively cumbersome to adjust, and in the event the extra plates are misplaced, the adjustment feature is no longer available.

SUMMARY OF THE INVENTION

It is an object of the present invention to provide a motorcycle muffler, the back pressure through which may be easily adjusted.

The present invention is for an adjustable motorcycle muffler affixable to the exhaust pipe of a motorcycle. The muffler has a generally cylindrical muffler body affixable to the exhaust pipe of a motorcycle. A perforated muffler pipe is mounted in an axial manner within the muffler body and the perforated muffler pipe has a plurality of sound absorbing openings therethrough. A stationary ring is affixed to the exit end of the muffler body and the stationary ring has a plurality of longitudinally aligned openings therethrough. An adjustable ring is affixed to the stationary ring, and the adjustable ring is movable to enlarge the gas flow path through the openings in the stationary ring so that the movement of the adjustable ring changes the exhaust gas flow resistance through the stationary ring. In this way, the muffler may be tuned to provide an optimum amount of exhaust backflow resistance. The adjustment may be provided by a turning of the adjustable ring, in which case the adjustable ring has openings which match the openings in the stationary ring when the two rings are aligned. Alternatively, the adjustable ring may be longitudinally adjustable to reduce the exhaust gas flow resistance as the adjustable ring is moved away from the stationary ring. Preferably, the adjustable ring is easily adjusted by turning the adjustable ring with respect to the stationary ring. In the configuration where both rings have matching openings, preferably the outer face of the stationary ring is held against the inner face of the adjustable ring by a spring so that the adjustable ring may simply be turned and held by friction in the desired location.

BRIEF DESCRIPTION OF THE DRAWINGS

FIG. 5 is an exploded, perspective view of the adjustable portion of the muffler of FIG. 1.

FIG. 6 is an enlarged end view showing the adjustable portion of the muffler of FIG. 1 in a partially turned position.

FIG. 7 is an enlarged end view of an alternate configuration of the adjustable muffler of FIG. 1.

FIG. 8 is an enlarged cross-sectional view, analogous to that of FIG. 4, showing an alternate construction of the adjustable portion of the muffler of FIG. 1.

DESCRIPTION OF THE PREFERRED EMBODIMENTS

Figure 1:
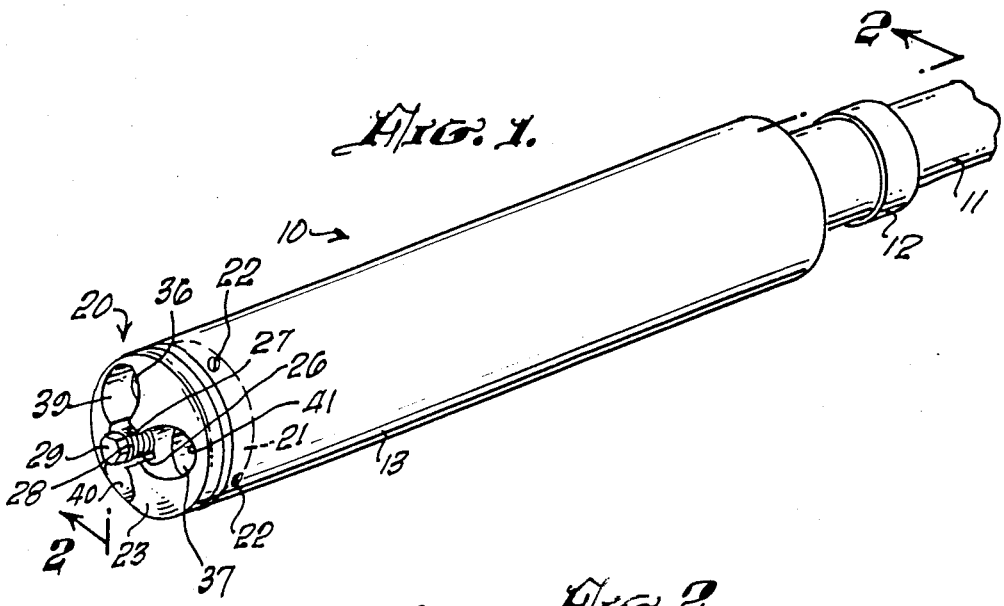
FIG. 1 is a perspective view of the adjustable motorcycle muffler of the present invention.
Figure 2:
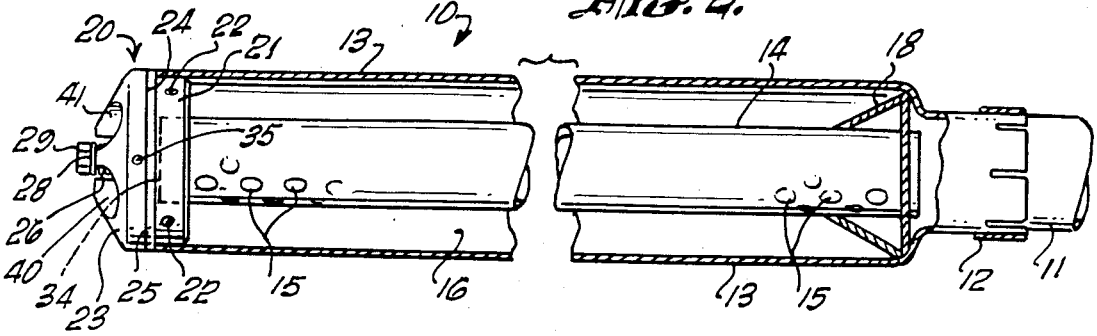
FIG. 2 is a cross-sectional view taken along line 2—2 of FIG. 1.
Figure 3:
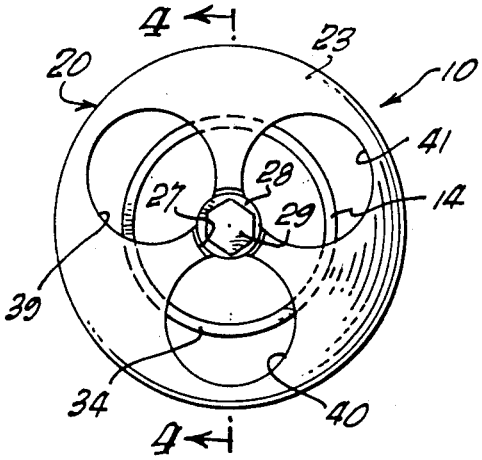
FIG. 3 is an enlarged end view thereof.

The adjustable motorcycle muffler of the present invention is shown in perspective view in FIG. 1 and indicated by reference character 10. Muffler 10 is held to exhaust pipe 11 by a conventional clamp ring 12. Muffler 10 has a muffler body 13 which also is conventional. As shown in FIG. 2, muffler body 13 supports a perforated muffler pipe 14 which has a plurality of openings 15, leading into an annular space 16 which may be packed with fiberglass or other sound absorbing material. Annular space 16 may also simply be vacant. Pipe 14 is held within muffler body 13 by a conical sleeve 18 and by the adjustable unit described below.

Muffler 10 has an adjustable unit indicated generally by reference character 20 which consists of a stationary ring 21 which is held to muffler body 13 by a plurality of screws 22. An adjustable ring 23 has an inner flat face 24 which abuts the outer flat face 25 of stationary ring 21. Stationary ring 21 has three axially aligned openings 36, 37 and 38 which are identical in size and orientation with axial openings 39, 40 and 41 in adjustable ring 23.

So that adjustable ring 23 will remain in its set position, it is held securely against face 24 by a spring 26 held in a spring recess 27 by washer 28 on bolt 29. Bolt 29 is threaded into a threaded opening 30 in stationary ring 21 and secured thereto by a nut 31 and lock washer 32. This construction is shown clearly in exploded view in FIG. 5 where it can also readily be seen that stationary member 21 has a recess 33 for placement over the end 34 of perforated muffler pipe 14.

Figure 4:
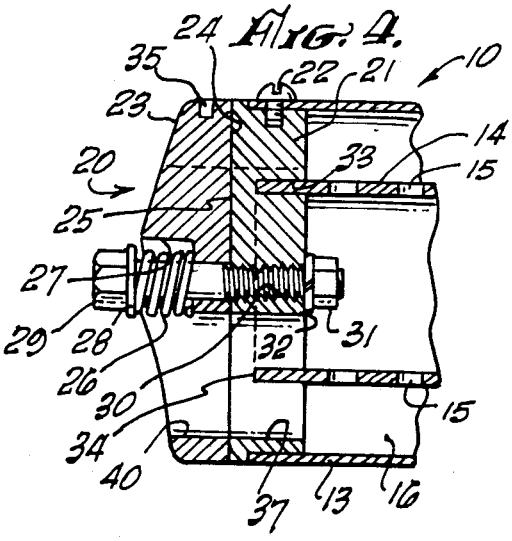
FIG. 4 is a cross-sectional view taken along line 4—4 of FIG. 3.

In order to adjust the back flow of muffler 10, one simply inserts a screw driver or other object in one of the openings 35 in the periphery of adjustable ring 23 and the adjustable ring is turned, as indicated in FIG. 6, which increases the back pressure as compared to the back pressure occurring when the openings are aligned as shown in FIG. 4. Because of the pressure between faces 24 and 25 caused by spring 26, the adjustable ring will stay in its adjusted position. Thus, it can be seen that an adjustment may be easily made without any disassembly of the muffler.

An alternate configuration of openings is shown in FIG. 7 where axially aligned openings 42 through 46 are aligned with identical-sized openings in the stationary member and operate in the same manner as openings 39, 40 and 41.

An alternate method of holding adjustable ring 23 against stationary ring 21 is shown in FIG. 8 where a bolt 47 has a washer 48 which abuts a spring 49 which also abuts the inner face of stationary ring 21. Bolt 47 is threaded into adjustable ring 23 and a nut 50 and washer 51 are held on the end of bolt 47.

Figure 9:
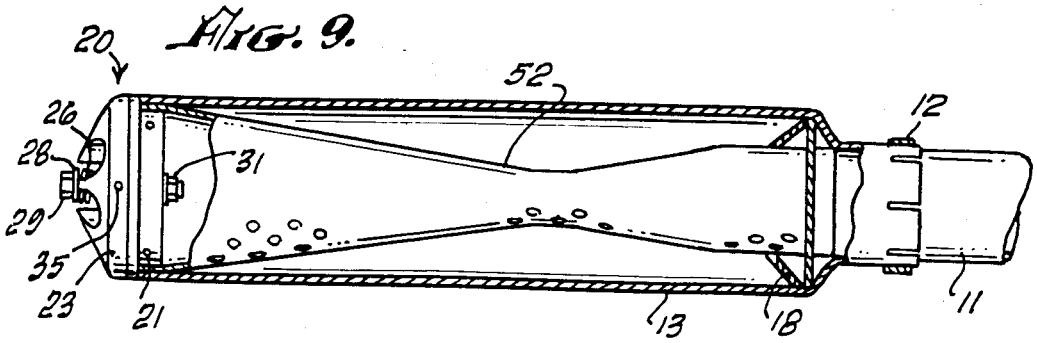
FIG. 9 is a cross-sectional view of an alternate configuration of muffler of FIG. 1.

While the perforated muffler pipe 14 of FIG. 2 is shown as a cylindrical pipe, it can, instead, have a restricted shape such as shown in FIG. 9 where the perforated pipe is indicated by reference character 52. This design permits the full flow of exhaust gasses from the interior of perforated pipe 52 through the stationary and adjustable rings 21 and 23.

Figure 10:
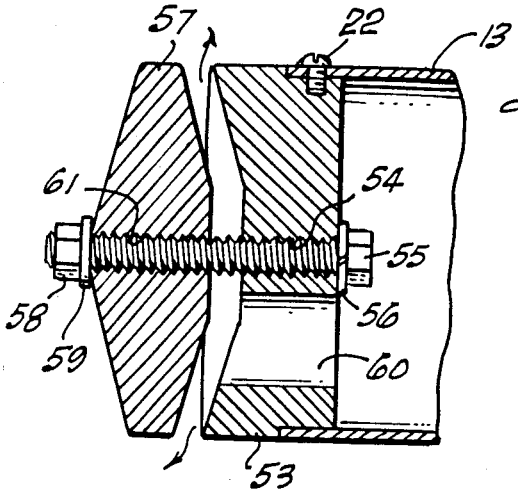
FIG. 10 is a cross-sectional view of an alternate configuration of flow-restricting device of the muffler of FIG. 1.

Another method of adjusting the back flow pressure is shown in FIG. 10 where stationary ring 53 has a threaded opening 54 into which a bolt 55 is secured by a lock washer 56. An adjustable ring 57 may be moved inwardly or outwardly by turning the same with respect to bolt 55. Adjustable ring 57 is then tightened into the desired position by tightening nut 58 against lock washer 59. Stationary ring 53 has three openings analogous to stationary ring 21 and the lower opening is shown in FIG. 10 and indicated by reference character 60. Adjustable ring 57 is solid except for a threaded hole 61. The exhaust gas would thus flow through the passageway between stationary ring 53 and adjustable ring 57 in the direction indicated by the arrows in FIG. 10.

Figure 11:
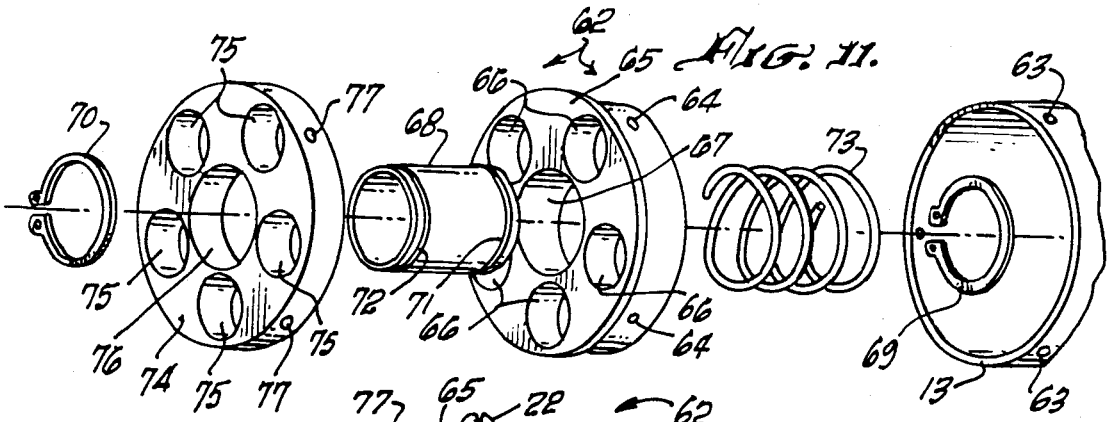
FIG. 11 is an exploded perspective view showing an alternate configuration of the adjustable end member of the muffler of FIG. 1.

An alternate configuration of the adjustable portion of the muffler of FIG. 1 is shown in exploded perspective view in FIG. 11 and indicated generally by reference character 62. The adjustable portion 62 is affixed to the muffler body 13 by a plurality of screws, not shown, which pass through holes 63 in muffler body 13. These holes are aligned with threaded openings 64 in stationary ring 65. A plurality of screws 22 are inserted in threaded opening 64 in a conventional manner.

Figure 12:
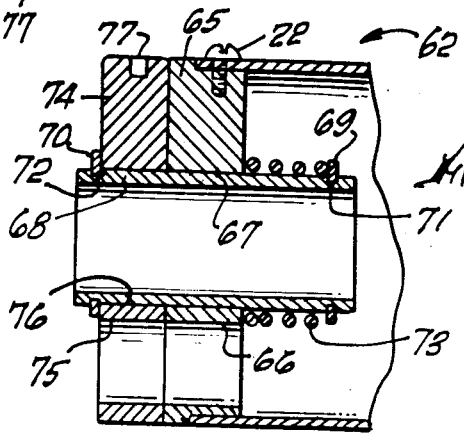
FIG. 12 is a cross-sectional side view of the adjustable end member of FIG. 11.

Stationery ring 65 has five peripheral openings 66 and a central opening 67. A central tube 68 passes through central opening 67, as shown in FIG. 12, and is held in place by a pair of clips 69 and 70 which snap into a pair of grooves 71 and 72 on tube 68. A spring 73 is compressed against stationary ring 65 and clip 69 which thus urges clip 70 against adjustable ring 74 as shown in FIG. 12. Adjustable ring 74 has five peripheral openings 75 and a central opening 76. Peripheral openings 75 are identical in size and spacing as peripheral openings 66 and thus can be aligned to minimize the exhaust gas flow restriction. A plurality of adjustment openings 77 assist the turning of adjustable ring 74 with respect to stationary ring 65 thereby increasing or decreasing the exhaust gas flow restriction.

The construction of the adjustable muffler of the present invention provides an exceptionally easy-to-adjust muffler which permits the user to quickly tune his muffler depending upon the type of riding conditions anticipated. That is, if high speed riding is expected, the muffler can be turned to a position which optimizes power at a high speed. If slower in-city riding is expected, the muffler can be tuned for a lower anticipated speed and quieter operation. The stationary ring and adjustable ring may be fabricated from aluminum and the spring, if used, should be heat resistant since it is subjected to relatively high temperatures. It is also possible that a ball and detent feature could be added between the faces of the stationary ring and adjustable ring.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An adjustable motorcycle muffler affixable to the exhaust pipe of a motorcycle, said muffler comprising:

a generally cylindrical muffler body affixable to the exhaust pipe of a motorcycle;

a perforated muffler pipe mounted in an axial manner within said muffler body, said perforated muffler pipe having a plurality of sound absorbing openings therethrough;

a stationary ring affixed to the exit end of the muffler body, said stationary ring having a plurality of longitudinally aligned openings therethrough;

an adjustable ring affixed to the stationary ring, said adjustable ring being movable to enlarge the gas flow path through the openings in the stationary ring, whereby the movement of the adjustable ring changes the exhaust gas flow resistance through the stationary ring so that the muffler may be tuned to provide an optimum amount of back flow resistance.

2. The adjustable motorcycle muffler of claim 1 wherein the movement of the adjustable ring is in a circular direction and the adjustable ring has a plurality of longitudinally aligned openings matching the openings in the stationary ring.

3. The adjustable motorcycle muffler of claim 1 wherein the movement of the adjustable ring is longitudinal so that the movement of the adjustable ring away from the stationary ring decreases the resistance of flow through the muffler.

4. The adjustable motorcycle muffler of claim 3 wherein the stationary ring has a conical depression in its outer face and the adjustable ring has a conical inner end which matches the conical depression of the stationary ring.

5. An adjustable motorcycle muffler affixable to the exhaust pipe of a motorcycle, said muffler comprising:

a generally cylindrical muffler body affixable to the exhaust pipe of a motorcycle;

a perforated muffler pipe mounted in an axial manner within said muffler body, said perforated muffler pipe having a plurality of sound absorbing openings therethrough;

a stationary ring affixed to the exit end of the muffler body, said stationary ring having a plurality of longitudinally aligned openings therethrough;

a turnable ring affixed to the stationary ring, said turnable ring having a plurality of axially aligned openings corresponding to the openings in the stationary ring and said turnable ring including means to affix the turnable ring in a desired orientation with respect to the stationary ring, whereby the turning of the turnable ring changes the exhaust gas flow resistance from a minimum when the holes in the turnable ring are aligned with the holes in the stationary ring to a maximum when the holes are at a farthest distance from alignment so that the muffler may be tuned to provide an optimum amount of back flow resistance.

6. The adjustable motorcycle muffler of claim 5 wherein the means for affixing the turnable ring in a desired orientation with respect to the stationary ring comprises biasing means urging the turnable ring against the stationary ring.

7. The adjustable motorcycle muffler of claim 5 wherein the stationary ring has a circular support groove to hold the exit end of the perforated muffler pipe.

8. The adjustable motorcycle muffler of claim 5 wherein the stationary ring has a portion which fits within the end of the muffler body and is secured thereto by a plurality of fasteners passing through the muffler body and into the stationary ring.

9. The adjustable motorcycle muffler of claim 5 wherein the stationary ring and the adjustable ring each have three openings therethrough.

10. The adjustable motorcycle muffler of claim 5 wherein the stationary ring and the adjustable ring each have five openings therethrough.

11. The adjustable motorcycle muffler of claim 5 wherein the adjustable ring is held against the face of the stationary ring by a spring held in an axial cavity in the face of the adjustable ring, said spring being held in said cavity by a bolt which is threaded into the stationary member.

12. The adjustable motorcycle muffler of claim 5 wherein the adjustable ring is held against the face of the stationary ring by a spring held against the inner face of the stationary ring by a bolt threaded into the adjustable ring.

13. The adjustable motorcycle muffler of claim 5 wherein the perforated muffler pipe has an inner passageway which narrows to a minimum diameter near the center thereof and widens to touch the interior surface of the muffler body near the exit end of the muffler body.

14. The adjustable motorcycle muffler of claim 5 further including a plurality of adjustment openings in the exterior periphery of the adjustable ring to facilitate the turning of the adjustable ring with respect to the stationary ring.

15. The adjustable motorcycle muffler of claim 5 wherein said stationary ring has a central opening and wherein said turnable ring also has a central opening, and the turnable ring is held to the stationary ring by a tube which passes through both of said central openings.

16. The adjustable motorcycle muffler of claim 15 wherein said tube has first and second ends and has a spring surrounding one of said ends and abutting one of said adjustable ring and said stationary ring.

17. The adjustable motorcycle muffler of claim 16 wherein said spring abuts said stationary ring.

* * * * *